US009090087B2

(12) United States Patent
Bansyo

(10) Patent No.: US 9,090,087 B2
(45) Date of Patent: Jul. 28, 2015

(54) INKJET PRINTING MACHINE

(71) Applicant: Riso Kagaku Corporation, Tokyo (JP)

(72) Inventor: Toshihiro Bansyo, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/291,809

(22) Filed: May 30, 2014

(65) Prior Publication Data

US 2014/0354732 A1 Dec. 4, 2014

(30) Foreign Application Priority Data

May 31, 2013 (JP) ..... 2013-114879

(51) Int. Cl.
*B41J 2/155* (2006.01)
*B41J 29/38* (2006.01)
*B41J 2/21* (2006.01)

(52) U.S. Cl.
CPC ..... *B41J 2/2146* (2013.01); *B41J 2/2135* (2013.01)

(58) Field of Classification Search
USPC ..... 347/20, 42, 5
See application file for complete search history.

(56) References Cited

FOREIGN PATENT DOCUMENTS

JP 2012-066510 4/2012

*Primary Examiner* — Jason Uhlenhake
(74) *Attorney, Agent, or Firm* — Greenblum & Bernstein P.L.C.

(57) ABSTRACT

A controller is configured to control ink ejection timings of a plurality of head modules on a basis of a positional relation in a print width direction of a sheet between nozzles, covering a same pixel, of the plurality of head modules of different colors in each of a plurality of head module lines such that, among landing positions of inks from the nozzles of the different colors covering the same pixel, the landing position of the ink from the nozzle of at least one of the different colors is shifted in a transfer direction of the sheet from the landing positions of the inks from the nozzles of the other colors in at least one of the plurality of head module lines.

10 Claims, 8 Drawing Sheets

INKJET PRINTING MACHINE

CROSS REFERENCE TO RELATED APPLICATION

This application is based upon and claims the benefit of priority from the prior Japanese Patent Application No. 2013-114879, filed on May 31, 2013, the entire contents of which are incorporated herein by reference.

BACKGROUND

1. Technical Field

The present invention relates to an inkjet printing machine configured to perform printing by ejecting inks onto a sheet from ink heads.

2. Related Art

There have been line-type inkjet printing machines configured to eject an ink onto a sheet from a fixed ink head while transferring the sheet. Such a line-type inkjet printing machine uses an ink head formed of multiple head modules aligned in the print width direction (main scanning direction) (see Japanese Patent Application Publication No. 2012-66510).

In a line-type inkjet printing machine capable of color printing with inks of multiple colors, multiple ink heads configured to eject inks of different colors are arranged at certain intervals in the sheet transfer direction (sub scanning direction). For color printing, the ink heads are driven at different timings so that the inks of the different colors ejected from the nozzles of the ink heads can land and overlap each other in each pixel on the transferred sheet.

The head modules forming the ink heads are attached to a head holder. It is difficult to precisely adjust the positions of the head modules so that the inks of the different colors can land on their respective right positions without shifting in each pixel because a large amount of man-hours and high cost are required for the attachment. For this reason, the head modules are often offset from the right positions.

The offset in the attached positions of the head modules in the sub scanning direction has heretofore been compensated by adjusting the ink ejection timings of the head modules. On the other hand, as for the main scanning direction, which nozzles to use for each pixel of image data have been chosen for each head module line so as to minimize the offset in the positions, in the main scanning direction, of the nozzles of the head modules of the different colors covering the same pixel. Here, each head module line is formed of head modules of the different colors arranged in a line along the sub scanning direction.

SUMMARY

Meanwhile, even if the nozzles are chosen as mentioned above, the landing positions of the inks of the different colors may possibly be offset in the main scanning direction in a head module line in which the attached positions of its head modules are offset in the main scanning direction. For example, the maximum offset of two colors is ½ of the nozzle pitch, whereas the maximum offset of four or more colors is ¾ of the nozzle pitch.

Thus, in some cases, when the head module lines differ from each other in terms of the offset in the positions of their head modules in the main scanning direction, the inks of the different colors having landed on a sheet overlap each other in a different way from one head module line to another. This leads to a color difference in a printed image between the head module lines and as a result deteriorates the print quality.

An object of the present invention is to provide an inkjet printing machine capable of reducing the deterioration in print quality.

An inkjet printing machine in accordance with some embodiments includes: a printing unit configured to perform printing on a sheet while transferring the sheet in a transfer direction; and a controller configured to control the printing unit. The printing unit includes a plurality of head module groups arranged side by side in the transfer direction and configured to eject inks of different colors. Each of the plurality of head module groups includes a plurality of head modules aligned along a print width direction perpendicular to the transfer direction and configured to eject an ink of a same color. Each of the plurality of head modules includes a plurality of nozzles arranged along the print width direction at a nozzle pitch and configured to eject the ink. The plurality of head modules forms a plurality of head module lines arranged side by side in the print width direction, each of the head module lines including head modules of the different colors of the head modules arranged in a line along the transfer direction and configured to eject the inks of the different colors. The controller is configured to control ink ejection timings of the plurality of head modules on a basis of a positional relation in the print width direction between the nozzles, covering a same pixel, of the plurality of head modules of the different colors in each of the plurality of head module lines such that, among landing positions of the inks from the nozzles of the different colors covering the same pixel, the landing position of the ink from the nozzle of at least one of the different colors is shifted in the transfer direction from the landing positions of the inks from the nozzles of the other colors in at least one of the plurality of head module lines.

According to the above configuration, based on the positional relation in the print width direction between the nozzles, covering the same pixel, of the head modules of the different colors in the plurality of head module lines, the controller controls the ink ejection timings of the head modules. In this way, it is possible to reduce the color difference in a printed image among the head module lines resulting from the difference among the head module lines in the offset of the positions of their head modules in the print width direction, via adjustment of the landing positions of the inks of the different colors in the sheet transfer direction. Accordingly, the deterioration in print quality can be reduced.

The plurality of head module groups may include a first head module group configured to eject an ink of a first color and a second head module group configured to eject an ink of a second color. The controller may be configured to: determine a mapping between the nozzles of the first and second head module groups such that a distance in the print width direction between center positions of the nozzles of the first head module group and the second head module group covering the same pixel becomes equal to or smaller than ½ of the nozzle pitch; and control the ink ejection timings of the plurality of head modules such that a distance between the landing positions of the ink of the first color and the ink of the second color covering the same pixel becomes equal to a largest print-width-direction offset amount. The largest print-width-direction offset amount may be a largest amount of offset in the print width direction between the inks from the nozzles of the head modules of the first head module group and the second head module group covering the same pixel among the plurality of head module lines.

According to the above configuration, the controller controls the ink ejection timings of the head modules such that the distance between the landing positions of the ink of the first color and the ink of the second color covering the same pixel becomes substantially equal to the largest print-width-direction offset amount. In this way, it is possible to reduce the color difference in a printed image among the head module lines in an inkjet printing machine with two head module groups. Accordingly, the deterioration in print quality can be reduced.

The plurality of head module groups may include a first head module group configured to eject an ink of a first color, a second head module group configured to eject an ink of a second color, and a third head module group configured to eject an ink of a third color. The controller may be configured to: determine a mapping among the nozzles of the first to third head module groups such that a distance in the print width direction between center positions of the nozzles of the first head module group and the second head module group covering the same pixel becomes equal to or smaller than ½ of the nozzle pitch and such that a distance in the print width direction between the center position of the nozzles of the second head module group and a center position of the nozzles of the third head module group covering the same pixel becomes equal to or smaller than ½ of the nozzle pitch; and control the ink ejection timings of the plurality of head modules such that a distance between the landing positions of the ink of the second color and the ink of the third color covering the same pixel becomes equal to a largest print-width-direction offset amount and such that the landing position of the ink of the first color becomes the same as an intermediate position in the transfer direction between the landing positions of the ink of the second color and the ink of the third color. The largest print-width-direction offset amount may be a largest amount of offset in the print width direction between the inks from the nozzles of the head modules of the second head module group and the third head module group covering the same pixel among the plurality of head module lines.

According to the above configuration, the controller controls the ink ejection timings of the head modules such that the distance between the landing positions of the ink of the second color and the ink of the third color covering the same pixel becomes substantially equal to the largest print-width-direction offset amount, and the landing position of the ink of the first color becomes substantially the same as the intermediate position in the transfer direction between the landing positions of the ink of the second color and the ink of the third color. In this way, it is possible to reduce the color difference in a printed image among the head module lines in an inkjet printing machine with three head module groups. Accordingly, the deterioration in print quality can be reduced.

The plurality of head module groups may further include a fourth head module group configured to eject an ink of a fourth color. The controller may be configured to: determine a mapping among the nozzles of the first to fourth head module groups such that a distance in the print width direction between an intermediate position in the print width direction between the center positions of the nozzles of the second head module group and the third head module group covering the same pixel, and a center position of the corresponding nozzle of the fourth head module group becomes equal to or smaller than ½ of the nozzle pitch; for the head module line in which the landing positions of the ink of the second color and the ink of the third color covering the same pixel are the same position in the transfer direction, control an ejection timing of the ink of the fourth color such that a distance in the transfer direction between the landing position of the ink of the fourth color and the landing position of the ink of the second color and the ink of the third color becomes equal to $(\sqrt{3})/2$ of a distance in the print width direction between the landing position of the ink of the second color and the landing position of the ink of the third color; and for the head module line in which the landing positions of the ink of the second color and the ink of the third color covering the same pixel are different positions in the transfer direction, control the ejection timing of the ink of the fourth color such that a distance between the landing position of the ink of the second color and the landing position of the ink of the fourth color, and a distance between the landing position of the ink of the third color and the landing position of the ink of the fourth color become equal.

According to the above configuration, for the head module line in which the landing positions of the ink of the second color and the ink of the third color covering the same pixel are substantially the same position in the transfer direction, the controller controls the ejection timing of the ink of the fourth color such that the distance in the transfer direction between the landing position of the ink of the fourth color and the landing position of the ink of the second color and the ink of the third color becomes equal to $(\sqrt{3})/2$ of the distance in the print width direction between the landing position of the ink of the second color and the landing position of the ink of the third color. Moreover, for the head module line in which the landing positions of the ink of the second color and the ink of the third color covering the same pixel are different positions in the transfer direction, the controller controls the ejection timing of the ink of the fourth color such that the distance between the landing position of the ink of the second color and the landing position of the ink of the fourth color, and the distance between the landing position of the ink of the third color and the landing position of the ink of the fourth color become substantially equal. In this way, it is possible to reduce the color difference in a printed image among the head module lines in an inkjet printing machine with four head module groups. Accordingly, the deterioration in print quality can be reduced.

The controller may be configured to limit a distance in the transfer direction between the intermediate position between the landing positions of the ink of the second color and the ink of the third color covering the same pixel, and the landing position of the ink of the fourth color, to a predetermined distance or smaller.

According to the above configuration, the controller limits the distance in the transfer direction between the intermediate position between the landing positions of the ink of the second color and the ink of the third color covering the same pixel, and the landing position of the ink of the fourth color, to a predetermined distance or smaller. In this way, it is possible to prevent a dot of the fourth color from getting too close to its adjacent line and affecting the print quality. In addition, it is possible to prevent the dot of the fourth color from getting too far away from dots of the second and third colors in the same line and making color shift noticeable. Accordingly, the deterioration in print quality can be reduced.

The plurality of head module groups may further include a fifth head module group configured to eject an ink of a fifth color. The controller may be configured to: determine a mapping among the nozzles of the first to fifth head module groups such that a distance between the center positions of the nozzles, covering the same pixel, of the fifth head module group and the head module group of one of the first to fourth colors with a closest hue to the fifth color becomes equal to or smaller than ½ of the nozzle pitch; and control an ejection timing of the ink of the fifth color such that the landing positions, covering the same pixel, of the ink of the fifth color and the ink of the color with the closest hue to the fifth color become the same position in the transfer direction.

According to the above configuration, the controller controls the ejection timing of the ink of the fifth color such that the landing positions, covering the same pixel, of the ink of the fifth color and the ink of the color with the closest hue to the fifth color become substantially the same position in the transfer direction. In this way, it is possible to reduce the color difference in a printed image among the head module lines in an inkjet printing machine with five head module groups. Accordingly, the deterioration in print quality can be reduced.

The first color may be black. The controller may be configured to control the ink ejection timings of the plurality of head modules of the plurality of head module groups such that the landing positions of the ink of the first color ejected from the nozzles of the plurality of head modules of the first head module group become the same position in the transfer direction.

According to the above configuration, the first color is black, and the controller controls the ink ejection timings of the head modules of the head module groups such that the landing positions of the ink of the first color ejected from the nozzles of the head modules of the first head module group become substantially the same position in the transfer direction. Accordingly, it is possible to reduce the deterioration of printed images such as black letters and characters and black ruled lines whose misalignment is easily noticeable. In addition, it is possible to reduce the deterioration of printed images printed in only black.

The second color may be a reddish color.

According to the above configuration, the second color is a reddish color. Accordingly, it is possible to reduce the color shift of a reddish color whose color shift is easily noticeable and thus to reduce the color difference in a printed image among the head module lines.

DETAILED DESCRIPTION

Figure 1:
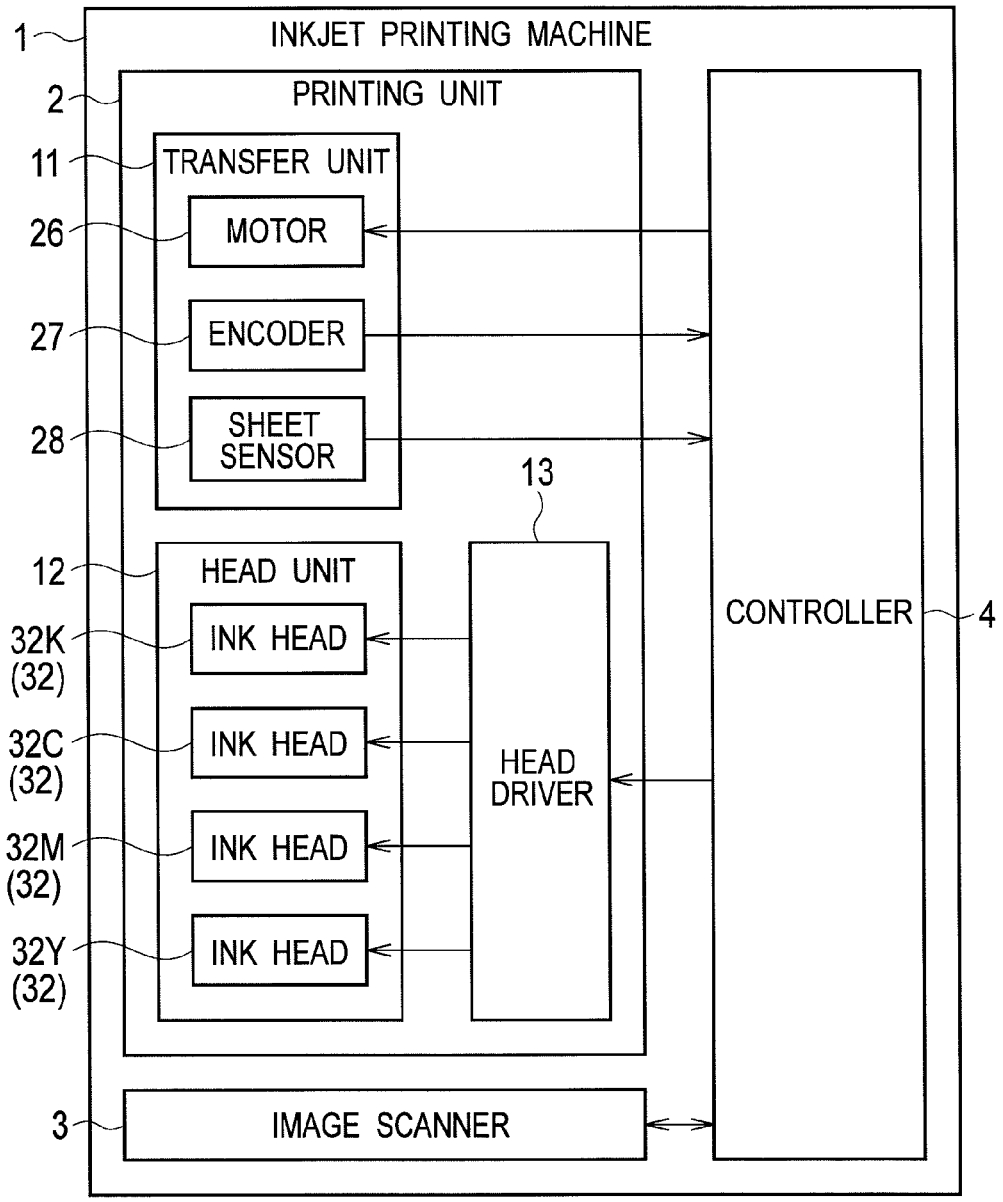
FIG. 1 is a block diagram showing the configuration of an inkjet printing machine according to an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Hereinbelow, an embodiment of the present invention will be described with reference to the drawings. The same or similar portions and constituent components in the drawings are denoted by the same or similar reference signs. However, it is to be noted that the drawings are schematic and differ from the actual ones. Moreover, some drawings naturally include portions with different dimensional relations and ratios.

Figure 2:
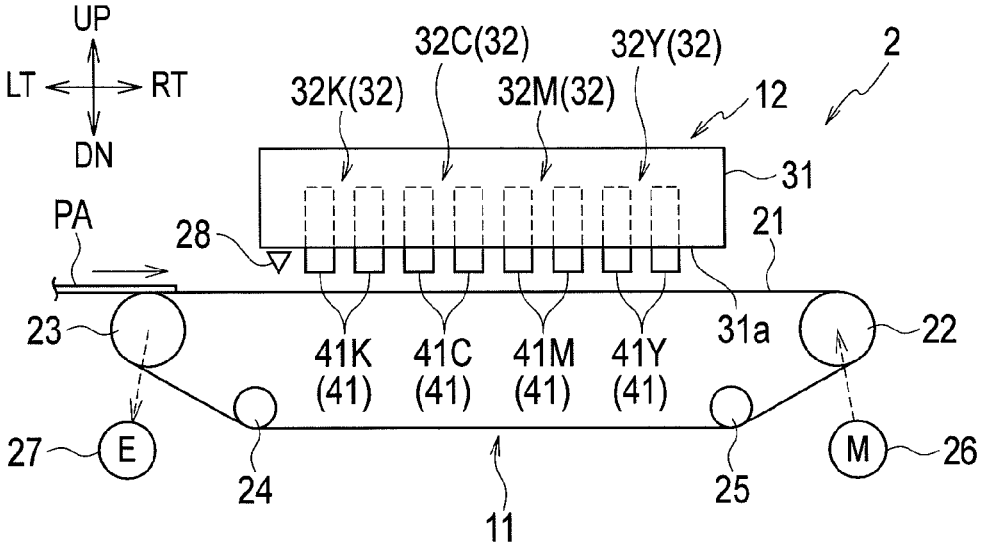
FIG. 2 is schematic configuration diagram of a printing unit.
Figure 3:
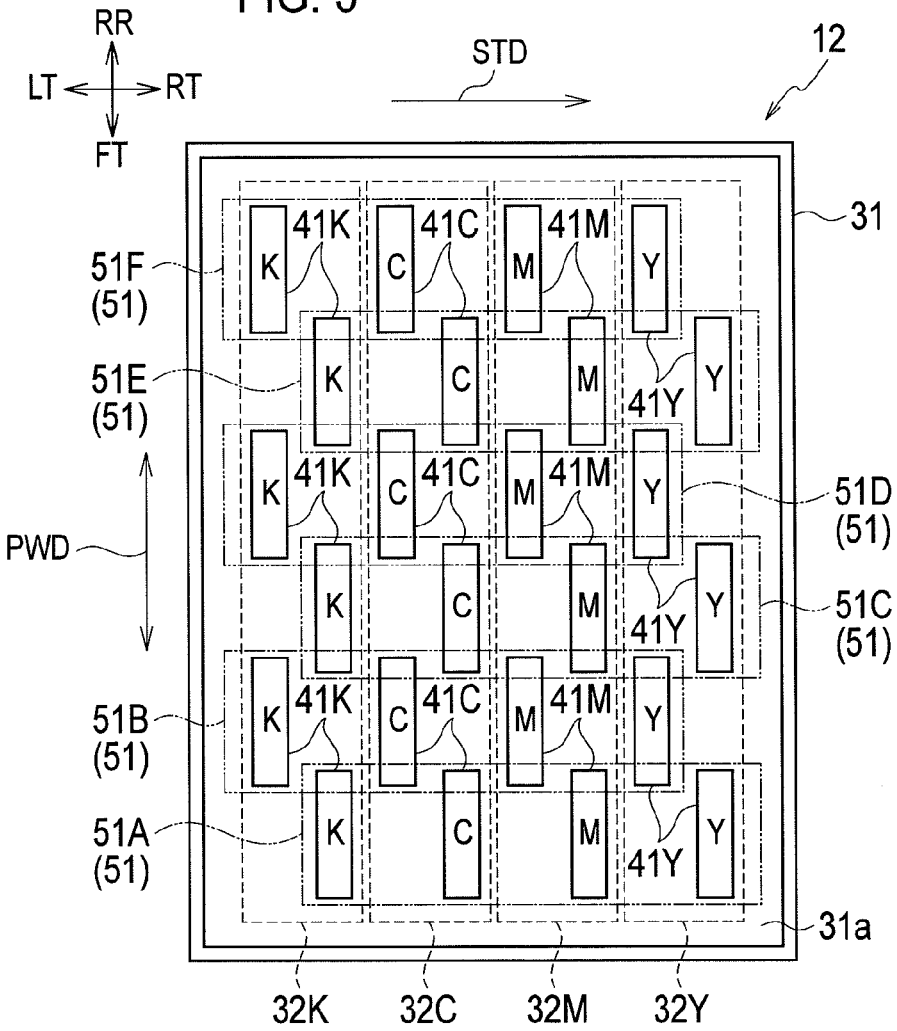
FIG. 3 is a plan view of a head unit.

FIG. 1 is a block diagram showing the configuration of an inkjet printing machine according to an embodiment of the present invention. FIG. 2 is a schematic configuration diagram of a printing unit of the inkjet printing machine shown in FIG. 1. FIG. 3 is a plan view of a head unit.

In the following description, a front-rear direction is a direction perpendicular to the plane of FIG. 2, and a front side is the front side of FIG. 2. Moreover, as shown in FIG. 2, upward, downward, leftward, and rightward directions are the upper, lower, left, and right sides as viewed from the front side, respectively. In FIG. 2, a direction from the left side to the right side is a sheet transfer direction. Upstream and downstream sides in the following description mean upstream and downstream sides in the sheet transfer direction. Note that in drawings, RT, LT, UP, DN, FT, and RR denote right, left, upper, lower, front, and rear directions, respectively. Moreover, in drawings, STD and PWD denote the sheet transfer direction and a print width direction, respectively.

As shown in FIG. 1, an inkjet printing machine 1 according to this embodiment includes a printing unit 2, an image scanner 3, and a controller 4.

The printing unit 2 is configured to perform printing on a sheet PA while transferring the sheet PA. The printing unit 2 includes a transfer unit 11, a head unit 12, and a head driver 13.

The transfer unit 11 is configured to transfer the sheet PA in the sheet transfer direction. As shown in FIGS. 1 and 2, the transfer unit 11 includes a transfer belt 21, a drive roller 22, driven rollers 23, 24, and 25, a motor 26, an encoder 27, and a sheet sensor 28.

The transfer belt 21 is an annular belt laid over the drive roller 22 and the driven rollers 23 to 25. The transfer belt 21 has many belt holes formed therein for holding the sheet PA by suction. The transfer belt 21 is configured to hold the sheet PA by suction by using sucking force generated at each belt hole by driving a fan (not shown). The transfer belt 21 is configured to transfer the sheet PA it holds by suction toward the right side by rotating clockwise in FIG. 2 by being driven by the drive roller 22.

The drive roller 22 and the driven rollers 23 to 25 are where the transfer belt 21 is laid. The drive roller 22 is configured to drive the transfer belt 21 by being rotationally driven by the motor 26. The driven rollers 23 to 25 are configured to be driven by the driver roller 22 through the transfer belt 21. The driven roller 23 is arranged at substantially the same level as the drive roller on the left side of the drive roller 22 with a predetermined clearance therebetween. The driven rollers 24 and 25 are arranged below the drive roller 22 and the driven roller 23 at substantially the same level with a predetermined clearance therebetween in the left-right direction.

The motor 26 is configured to rotationally drive the drive roller 22.

The encoder 27 is configured to output a pulse signal every time the driven roller 23 is rotated by a predetermined angle.

The sheet sensor 28 is configured to detect the sheet PA held by suction and transferred by the transfer belt 21. The sheet sensor 28 is arranged above the transfer belt 21 near and upstream of an ink head 32K to be described later. An optical sensor including a light emitting element and alight receiving element can be employed as the sheet sensor 28.

The head unit 12 is configured to print an image by ejecting inks onto the sheet PA transferred by the transfer unit 11. The head unit 12 is arranged above the transfer unit 11. The head unit 12 includes a head holder 31 and ink heads 32K, 32C, 32M, and 32Y. Note that these ink heads will also be described collectively as the ink head(s) 32 without the suffix alphabetical letters (K, C, M, and Y) in their reference signs indicating their colors in a case where the ink heads do not need to be distinguished from one another by color or in some other cases.

The head holder 31 is a casing configured to hold the ink heads 32. In a head holder surface 31*a* which is the bottom surface of the head holder 31, multiple openings (not shown) in which to attach multiple head modules 41 (41K, 41C, 41M, and 41Y) to be described later are formed at predetermined positions.

The ink heads 32K, 32C, 32M, and 32Y are configured to eject black (K), cyan (C), magenta (M), and yellow (Y) inks onto the transferred sheet PA, respectively. The ink heads 32K, 32C, 32M, and 32Y are arranged side by side in the left-right direction (sheet transfer direction) in this order from the upstream side with a clearance therebetween. The ink heads 32K, 32C, 32M, and 32Y are line-type inkjet heads and include multiple head modules 41K, 41C, 41M, and 41Y, respectively. In this embodiment, as shown in FIG. 3, the ink heads 32K, 32C, 32M, and 32Y are formed by arrays of six head modules 41K, 41C, 41M, and 41Y, respectively. Each ink head 32 corresponds to a head module group.

Each head module 41 includes multiple nozzles arranged at a predetermined nozzle pitch P in the front-rear direction, which is the print width direction (main scanning direction) substantially perpendicular to the sheet transfer direction (sub scanning direction), and is configured to eject the ink through the nozzles. Each head module 41 is inserted in one of the openings in the head holder surface 31*a* and attached such that its lower end portion protrudes downward from the head holder surface 31*a*. The six head modules 41 in each ink head 32 are arranged in a staggered pattern. Specifically, the six head modules 41 are aligned along the print width direction and arranged at alternately different positions in the sheet transfer direction. In other words, a total of 24 head modules 41 of the four colors are arranged in such a way as to form 6 head module lines 51A, 51B, 51C, 51D, 51E, and 51F, each of which includes head modules of the four colors 41K, 41C, 41M, and 41Y in the same line along the sheet transfer direction. Note that these head module lines will also be described collectively as the head module line(s) 51 without the suffix alphabetical letters in their reference signs 51A to 51F.

The head driver 13 is configured to drive the ink heads 32. Specifically, the head driver 13 drives each head module 41 of each ink head 32 and causes the head module 41 to eject the ink from its nozzles.

The image scanner 3 is configured to optically read an image of an original and create image data.

The controller 4 is configured to control the operation of components in the inkjet printing machine 1. The controller 4 includes a CPU, a RAM, a ROM, a hard disk drive, and the like. In a print operation, based on the positional relation in the print width direction among the nozzles, covering the same pixel, of the head modules 41 of the four colors in the head module lines 51A to 51F, the controller 4 controls the ink ejection timings of the head modules 41 in at least one of the head module lines 51 such that, among the landing positions of the inks of the four colors covering the same pixel, the landing position of the ink of one color is shifted in the sheet transfer direction from the landing positions of the inks of the other colors. This control on the ink ejection timings will be described later.

Next, the operation of the inkjet printing machine 1 will be described.

For printing, the controller 4 drives the transfer unit 11 by means of the motor 26. As the sheet PA is fed from a paper feed unit not shown, the transfer unit 11 transfers the sheet PA. Then, the controller 4 drives the ink heads 32K, 32C, 32M, and 32Y based on image data by means of the head driver 13 and causes the ink heads 32K, 32C, 32M, and 32Y to form images on the transferred sheet PA. In this process, the controller 4 sequentially drives the ink heads 32K, 32C, 32M, and 32Y such that the inks of the four colors land on pixels.

Meanwhile, as mentioned earlier, each head module 41 of each ink head 32 is attached to one of the openings formed in the head holder surface 31*a* at the predetermined positions, and the attached position of the head module 41 is sometimes offset. In the inkjet printing machine 1, the ink ejection timing of each head module 41 is controlled in such a way as to reduce the color difference in a printed image among the head module lines 51 resulting from the offset in the attached position of the head module 41.

A process for determining the amount of correction of the ejection timing of each head module 41 for the ink ejection timing control as above will be described with reference to a flowchart in FIG. 4.

Figure 4:
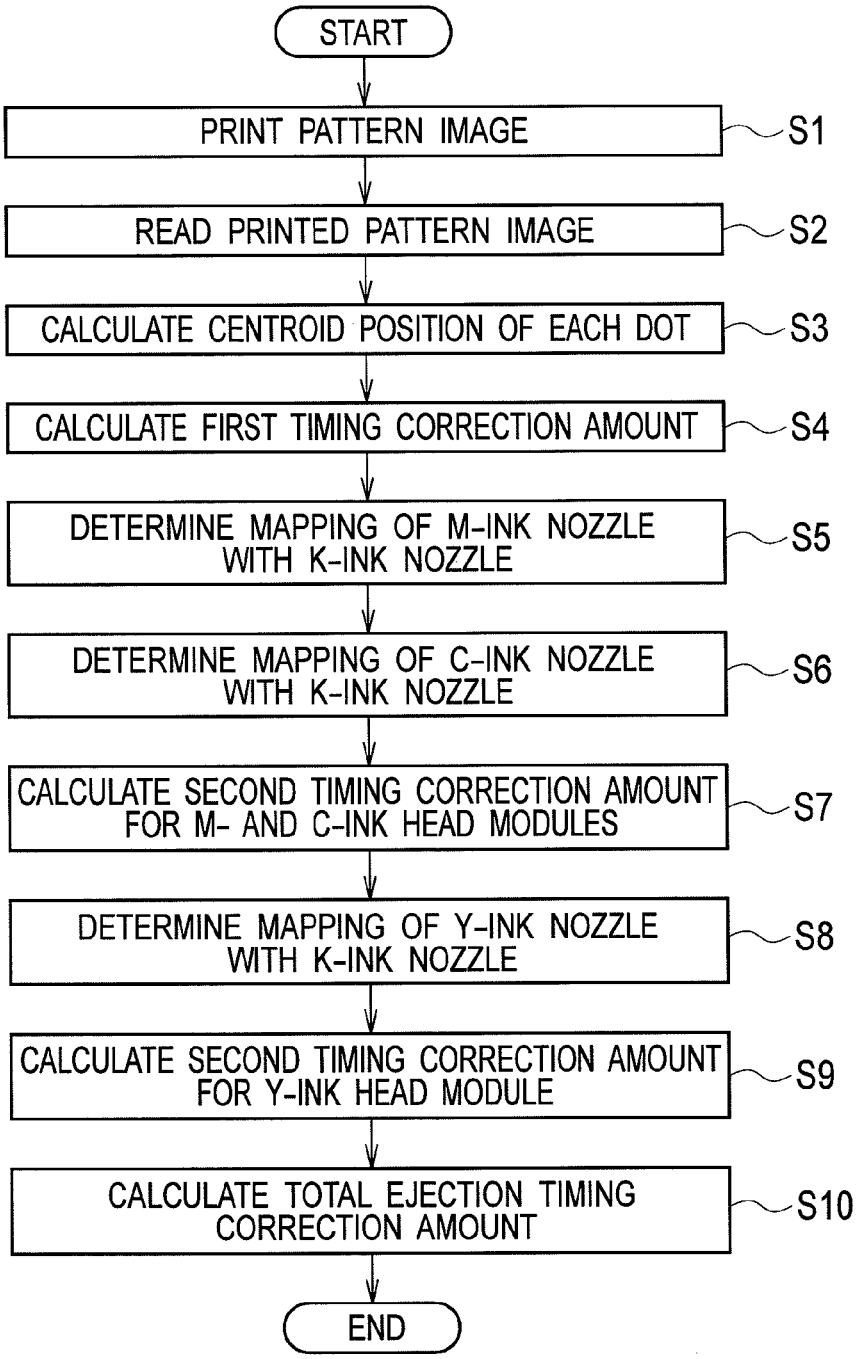
FIG. 4 is a flowchart of an ejection timing correction amount determining process.

First, in step S1 in FIG. 4, the controller 4 causes the printing unit 2 to print a preset pattern image on the sheet PA. The pattern image is an image for causing the head modules 41 of each ink head 32 to eject its ink from nozzles of the same nozzle number at preset timings to form dots on the same line. The nozzle number refers to a number indicating the order of the nozzle from one end in the main scanning direction.

When the printing of the pattern image is finished, the user performs an operation of causing the image scanner 3 to read the sheet PA on which the pattern image is printed. In step S2 in FIG. 4, the controller 4 in turn causes the image scanner 3 to read the printed pattern image. The image scanner 3 outputs image data obtained by reading the printed pattern image to the controller 4.

Then, in step S3, the controller 4 analyzes the image data on the printed pattern image and calculates the centroid position of the dot formed by each head module 41.

Here, in a case where all the head modules 41 are attached precisely at the right positions without any offset in their attached positions, the centroid positions of the dots of the four colors in each head module line 51 coincide with one another in the print width direction; moreover, the centroid positions of the dots in all the head module lines 51 are the same in the sheet transfer direction. In contrast, in a case where the attached position of a head module 41 is offset, the centroid position of the corresponding dot is offset in at least one of the print width direction and the sheet transfer direction.

Note that a pattern image involving causing each head module 41 to eject its ink from multiple nozzles may instead be used, and the average of the centroid positions of the multiple dots formed by each head module 41 may be used as the centroid position of dot in the head module 41.

Then, in step S4, the controller 4 calculates a first timing correction amount for each heat module 41. The first timing correction amount is an amount for correcting the offset in landing position resulting from the offset in the attached position of the head module 41 in the sheet transfer direction.

Specifically, first, the controller 4 sets one of the six head modules 41K configured to eject the K ink as a reference module. Then, for each head module 41 other than the reference module, the controller 4 calculates the distance (amount of offset) in the sheet transfer direction between the centroid position of the dot formed by the head module 41 and the centroid position of the dot formed by the reference module. Then, the controller 4 sets the amount of time required to complete sheet transfer of that distance at the transfer speed of the transfer unit 11 as the first timing correction amount for the head module 41. Here, the first timing correction amount is a negative value in a case of offset upstream of the dot formed by the reference module. The first timing correction amount for the reference module is zero.

Then, the controller 4 shifts the centroid position of each dot in the sheet transfer direction such that the centroid position of the dot coincides with the centroid position of the dot formed by the reference module in the sheet transfer direction.

Thereafter, in step S5, the controller 4 determines mapping of the nozzle of the head module 41M in each head module line 51 with the nozzle of the head module 41K in the head module line 51. Specifically, first, the controller 4 calculates the distance in the print width direction between the centroid position of the dot of the ink from the nozzle of the head module 41K in each head module line 51 and the centroid position of the dot of the ink from the nozzle of the head module 41M in the head module line 51.

If there is any head module line 51 in which this distance is greater than P/2 (half pitch), the controller 4 changes the mapping between the nozzle numbers of the head modules 41K and 41M in that head module line 51 (nozzles of the same nozzle number are initially mapped with each other). Specifically, the controller 4 changes the mapping between the nozzle numbers such that the amount of the offset, in the print width direction, of the nozzle of the head module 41M from the nozzle of the head module 41K becomes equal to or smaller than P/2, the nozzles of the head modules 41K and 41M covering the same pixel. For example, the mapping is determined such that the N-th nozzle of the head module 41K and the (N+1)-th nozzle of the head module 41M cover the same pixel. Then, if changing the mapping between the nozzle numbers of the head modules 41K and 41M, the controller 4 shifts the centroid position of the dot of the head module 41M in the print width direction in accordance with that change.

On the other hand, for each head module line 51 in which the distance in the print width direction between the centroid position of the dot of the head module 41K and the centroid position of the dot of the head module 41M is equal to or smaller than P/2, the controller 4 determines the mapping such that the nozzles of the head modules 41K and 41M sharing the same nozzle number cover the same pixel.

Figure 5:
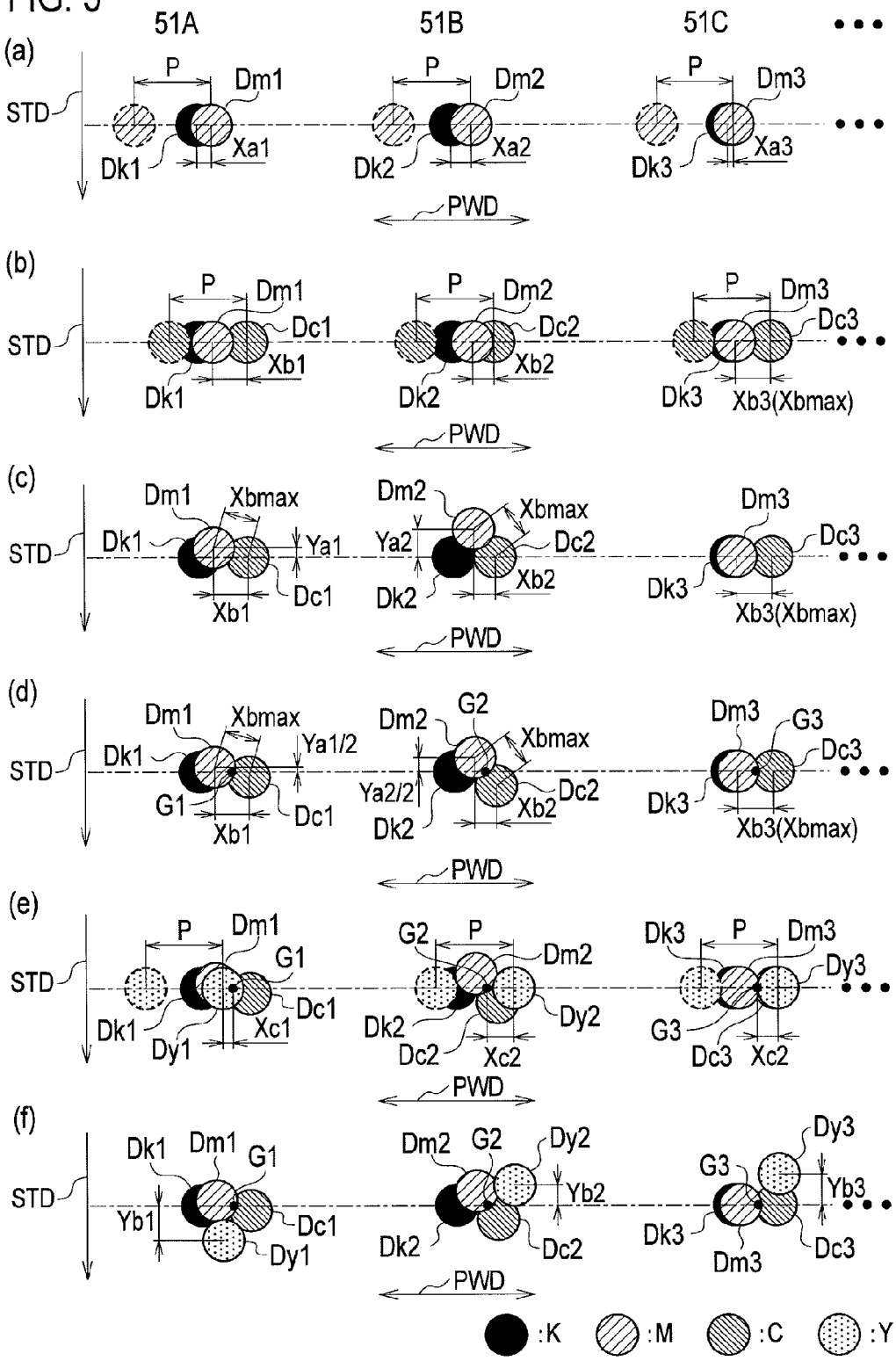
FIGS. 5(*a*) to 5(*f*) are explanatory diagrams of a procedure for calculating a second timing correction amount.

FIG. 5(*a*) shows an example of the positional relation up to this point between a dot Dkn (n=1, 2, . . . ) of the head module 41K and a dot Dmn (n=1, 2, . . . ) of the head module 41M covering the same pixel. Here, n=1, 2, . . . correspond to the orders in which the dots are arranged from the front side of the head module line 51. The first line is the head module line 51A and the sixth line is the head module line 51F. The positional relation in the print width direction between the centroid positions of the dots of different colors in FIGS. 5(*a*) to 5(*f*) correspond to the positional relation in the print width direction between the center portions of the nozzles of the head modules 41 of the different colors covering the same pixel. Up to the third head module line 51C are shown in FIGS. 5(*a*) to 5(*f*) since the space in the drawings is limited.

As shown in FIG. 5(*a*), Xan is the distance between the centroid position of the dot Dkn and the centroid position of the dot Dmn in the print width direction. Xan is equal to or smaller than P/2. Note that each dot illustrated by a broken line in FIG. 5(*a*) indicates the position of a dot formed when the ink is ejected from a nozzle next to the nozzle for the dot Dmn.

Referring back to FIG. 4, in step S6 after step S5, the controller 4 determines the mapping of the nozzle of the head module 41C in each head module line 51 with the nozzle of the head module 41K in the head module line 51. Specifically, first, the controller 4 calculates the distance in the print width direction between the centroid position of the dot Dkn of the head module 41K in each head module line 51 and the centroid position of the dot of the head module 41C in the head module line 51. Here, if the mapping between the nozzle numbers of the head modules 41K and 41M has been changed in step S5, the centroid position of the dot Dmn of the head module 41M is the position shifted in the print width direction as mentioned above.

If there is any head module line 51 in which the distance in the print width direction between the centroid position of the dot Dkn of the head module 41K and the centroid position of the dot of the head module 41C is greater than P/2, the controller 4 changes the mapping between the nozzle numbers of the head modules 41K and 41C in that head module line 51. Specifically, the controller 4 changes the mapping between the nozzle numbers of the head module 41K and the head module 41C such that the amount of the offset in the print width direction between the center positions of the nozzles of the head modules 41K and 41C covering the same pixel becomes equal to or smaller than P/2. For example, the mapping is determined such that the N-th nozzle of the head module 41K and the (N+1)-th nozzle of the head module 41C cover the same pixel. Then, if changing the mapping between the nozzle numbers of the head modules 41K and 41C, the controller 4 shifts the centroid position of the dot of the head module 41C in the print width direction in accordance with that change.

On the other hand, for each head module line 51 in which the distance in the print width direction between the centroid position of the dot Dkn of the head module 41K and the centroid position of the dot of the head module 41C is equal to or smaller than P/2, the controller 4 determines the mapping such that the nozzles of the head modules 41K and 41C sharing the same nozzle number cover the same pixel.

By steps S5 and S6 described above, the mapping among the nozzles of the ink heads 32K, 32M, and 32C is determined. As a result, the distance in the print width direction between the center positions of each nozzle of the ink head 32K and the corresponding nozzle of the ink head 32M covering the same pixel becomes equal to or smaller than P/2. Likewise, the distance in the print width direction between the center positions of each nozzle of the ink head 32M and the corresponding nozzle of the ink head 32C covering the same pixel becomes equal to or smaller than P/2.

FIG. 5 (*b*) shows an example of the positional relation up to this point among the dot Dkn of the head module 41K, the dot Dmn of the head module 41M, and a dot Dcn of the head module 41C covering the same pixel. As shown in FIG. 5(*b*), Xbn is the distance between the centroid position of the dot Dmn and the centroid position of the dot Dcn in the print width direction. Xbn is equal to or smaller than P/2. Note that each dot illustrated by a broken line in FIG. 5(*b*) indicates the position of a dot formed when the ink is ejected from a nozzle next to the nozzle for the dot Dcn.

Referring back to FIG. 4, in step S7 after step S6, the controller 4 calculates a second timing correction amount for each M-ink head module 41M and each C-ink head module 41C. The second timing correction amount is an amount for adjusting the landing position of the ink in the sheet transfer direction in order to reduce the color difference in a printed image among the head module lines 51 resulting from the offset in the attached positions of the head modules 41 in the print width direction.

Specifically, first, the controller 4 calculates a largest print-width-direction offset amount. The largest print-width-direction offset amount is the largest amount of offset in the print width direction between the nozzles of the head module 41M and the head module 41C covering the same pixel, among the head module lines 51A to 51F. Specifically, the largest print-width-direction offset amount is Xbn with a largest value Xbmax in FIGS. 5(*b*) to 5(*d*). In the example of FIGS. 5(*b*) to 5(*d*), the largest print-width-direction offset amount Xbmax is the distance Xb3 between the centroid position of the dot Dm3 and the centroid position of the dot Dc3 in the head module line 51C.

Thereafter, as shown in FIG. 5(*c*), the controller 4 shifts the dot Dmn of the head module 41M in each head module line 51 other than the head module line 51 in which Xbn is the largest print-width-direction offset amount Xbmax, in the sheet transfer direction by Yan. Yan is a shift amount by which the dot Dmn is shifted in the sheet transfer direction so that the distance between the centroid position of the dot Dmn and the centroid position of the dot Dcn can be substantially equal to the largest print-width-direction offset amount Xbmax.

Figure 6:
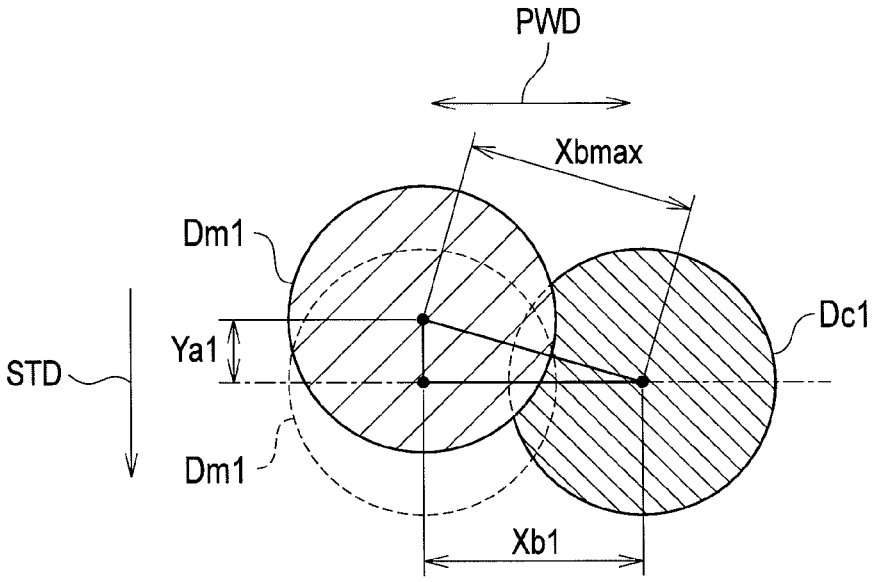
FIG. 6 is an explanatory diagram of a shift amount Yan.

In the example of FIGS. 5(*a*) to 5(*f*), the dot Dmn in each head module line 51 other than the head module line 51C is shifted by Yan in the sheet transfer direction. As shown in FIG. 6, in the case of the head module line 51A in the example of FIGS. 5(*a*) to 5(*f*), the dot Dm1 is shifted in the sheet transfer direction by Ya1, so that the distance between the dot Dm1 and the dot Dc1 becomes equal to the largest print-width-direction offset amount Xbmax. As can be seen from FIG. 6, the shift amount Yan is calculated from the following formula (1).

$$Yan=\sqrt{(Xb\max^2-Xbn^2)} \quad (1)$$

Note that although the dot Dmn is shifted toward the upstream side in the example of FIGS. 5(*a*) to 5(*f*) and FIG. 6, it may be shifted toward the downstream side instead.

Thereafter, as shown in FIG. 5(*d*), the controller 4 shifts the dot Dmn and the dot Dcn in each head module line 51 other than the head module line 51C by Yan/2 in the opposite direction to the direction in which the dot Dmn is shifted in FIG. 5(*c*). As a result, the position of an intermediate point Gn between the centroid position of the dot Dmn and the centroid position of the dot Dcn becomes substantially the same as the centroid position of the K-ink dot Dkn in the sheet transfer direction.

Then, the controller 4 calculates the amount of time required to complete sheet transfer of the distance Yan/2 at the transfer speed of the transfer unit 11 as the second timing correction amount for the head module 41M and the head module 41C. Here, the second timing correction amount is a negative value for a head module 41 with a dot Dmn or a dot Dcn shifted upstream of the centroid position of the dot Dkn.

In the example shown in FIG. 5(*d*), the second timing correction amount is a negative value for the head module 41M in the head module line 51A with the dot Dm1 and for the head module 41M in the head module line 51B with the dot Dm2. On the other hand, the second timing correction amount is a positive value for the head module 41C in the head module line 51A with the dot Dc1 and for the head module 41C in the head module line 51B with the dot Dc2. Note that the second timing correction amount is zero for the head module 41M in the head module line 51C with the dot Dm3 and for the head module 41C in the head module line 51C with the dot Dc3.

Referring back to FIG. 4, in step S8 after step S7, the controller 4 determines the mapping of the nozzle of the head module 41Y in each head module line 51 with the nozzle of the head module 41K in the head module line 51. Specifically, first, the controller 4 calculates the distance in the print width direction between the intermediate point Gn and the centroid position of the Y-ink dot in each head module line 51.

If there is any head module line 51 in which the distance between the intermediate point Gn and the centroid position of the Y-ink dot in the print width direction is greater than P/2, the controller 4 changes the mapping between the nozzle numbers of the head modules 41K and 41Y in that head module line 51. Specifically, the controller 4 changes the mapping between the nozzle numbers of the head module 41K and the head module 41Y such that the distance between the intermediate position in the print width direction between the nozzle of the head module 41M and the nozzle of the head module 41C covering the same pixel, and the center position of the nozzle of the head module 41Y becomes equal to or smaller than ½ of the nozzle pitch. For example, the mapping is determined such that the N-th nozzle of the head module 41K and the (N+1)-th nozzle of the head module 41Y cover the same pixel. Then, if changing the mapping between the nozzle numbers of the head modules 41K and 41Y, the controller 4 shifts the centroid position of the Y-ink dot in the print width direction in accordance with that change.

On the other hand, for each head module line 51 in which the distance between the intermediate point Gn and the centroid position of the Y-ink dot is equal to or smaller than P/2, the controller 4 determines the mapping such that the nozzles of the head modules 41K and 41Y sharing the same nozzle number cover the same pixel.

By step S8 described above, the mapping between the nozzles of the ink heads 32K and 32Y is determined. Since the mapping among the nozzles of the ink heads 32K, 32M, and 32C has been determined in steps S5 and S6 described earlier, the mapping among the nozzles of the ink heads 32K, 32M, 32C, and 32Y is determined by step S8. As a result, the distance in the print width direction between the intermediate position, in the print width direction, between each nozzle of the ink head 32M and the corresponding nozzle of the ink head 32C covering the same pixel, and the center position of the corresponding nozzle of the ink head 32Y becomes equal to or smaller than P/2.

FIG. 5 (*e*) shows an example of the positional relation up to this point among the K-ink dot Dkn, the M-ink dot Dmn, the C-ink dot Dcn, and the Y-ink dot Dyn covering the same pixel. As shown in FIG. 5(*e*), Xcn is the distance between the intermediate point Gn and the centroid position of the dot Dyn in the print width direction. Xcn is equal to or smaller than P/2. Note that each dot illustrated by a broken line in FIG. 5(*e*) indicates the position of a dot formed when the ink is ejected from a nozzle next to the nozzle for the dot Dyn.

Referring back to FIG. 4, in step S9 after step S8, the controller 4 calculates a second timing correction amount for each Y-ink head module 41Y.

Specifically, the controller 4 calculates an amount Ybn, shown in FIG. 5(*f*), by which to shift to the dot Dyn of the head module 41Y in the sheet transfer direction. How to calculate the shift amount Ybn will be described later. Then, the controller 4 calculates the amount of time required to complete sheet transfer of the distance Ybn at the transfer speed of the transfer unit 11 as the second timing correction amount for the head module 41Y. Here, the second timing correction amount is a negative value for a head module 41Y with a dot Dyn shifted upstream of the centroid position of the dot Dkn.

The shift amount Ybn is a shift amount for shifting the dot Dyn in the sheet transfer direction so that the distance between the centroid position of the dot Dmn and the centroid position of the dot Dyn and the distance between the centroid position of the dot Dcn and the centroid position of the dot Dyn will be substantially equal.

How to calculate the shift amount Ybn will be described with reference to FIGS. 7A and 7B by showing how to calculate the shift amount Yb1 for the head module line 51A in FIG. 5(*f*) as an example.

Figure 7A:
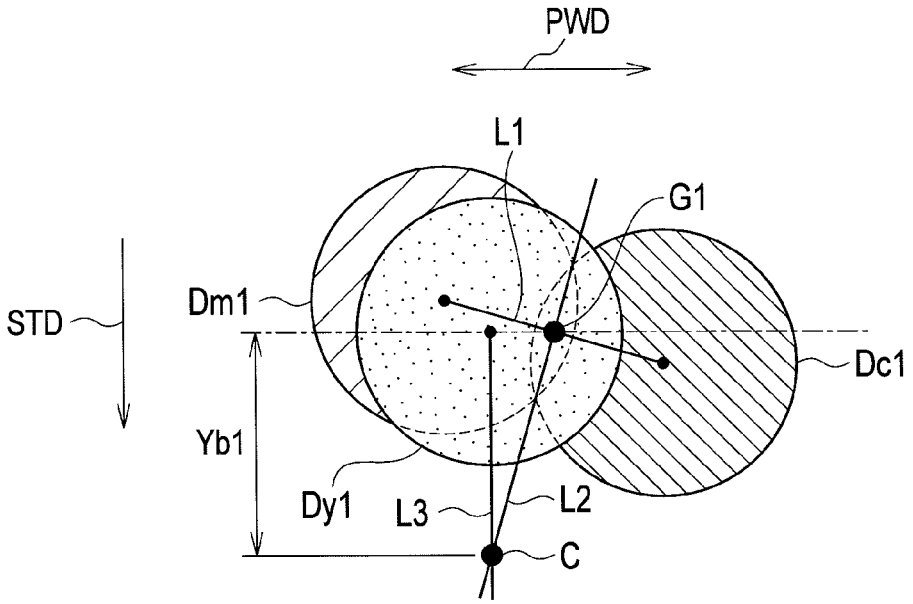
FIG. 7A is an explanatory diagram of a shift amount Ybn.

The controller 4 calculates the position of an intersection C of a straight line L2 passing the intermediate point G1 and perpendicularly crossing a line segment L1 connecting the centroid position of the dot Dmn and the centroid position of the dot Dcn, and a straight line L3 passing the centroid position of the dot Dyn and being parallel to the sheet transfer direction, as shown in FIG. 7A. Then, the controller 4 calculates the distance between the intermediate point G1 and the intersection C in the sheet transfer direction as the shift amount Yb1.

Figure 7B:
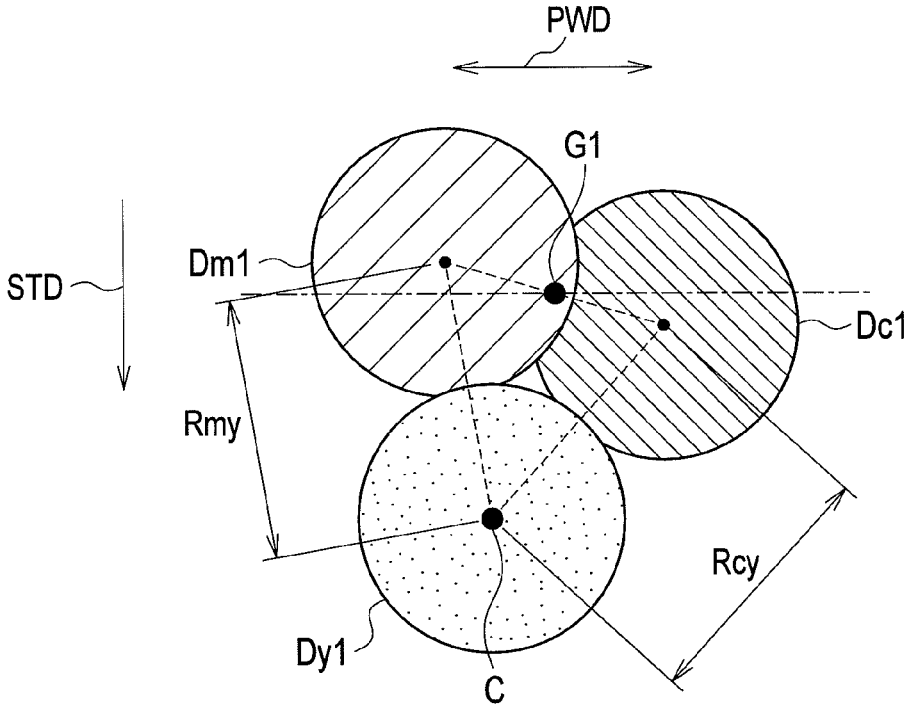
FIG. 7B is an explanatory diagram of the shift amount Ybn.

Now, by shifting the dot Dy1 by the shift amount Yb1 in the sheet transfer direction, a distance Rmy between the centroid position of the dot Dm1 and the centroid position of the dot Dy1 and a distance Rcy between the centroid position of the dot Dc1 and the centroid position of the dot Dy1, which are shown in FIG. 7B, become substantially equal to each other. Note that although the dot Dy1 is shifted toward the downstream side in the sheet transfer direction in the example of FIG. 5(*f*) and FIGS. 7A and 7B, it may be shifted toward the upstream side instead.

Meanwhile, for calculating the shift amount Ybn, the above method cannot be used to calculate the shift amount Ybn in a case of a head module line 51 in which the centroid position of the dot Dmn and the centroid position of the dot Dcn are substantially the same position in the sheet transfer direction. The reason is as follows.

First, suppose that the centroid position of the dot Dmn and the centroid position of the dot Dcn are substantially the same in the sheet transfer direction, and that the centroid position of the dot Dyn is not in between the centroid position of the dot Dmn and the centroid position of the dot Dcn in the print width direction. In this case, the distance between the centroid position of the dot Dmn and the centroid position of the dot Dyn and the distance between the centroid position of the dot Dcn and the centroid position of the dot Dyn will never become substantially equal to each other even if the dot Dyn is shifted in the sheet transfer direction.

On the other hand, in a case where the centroid position of the dot Dyn is in between the centroid position of the dot Dmn and the centroid position of the dot Dcn in the print width direction, the distance between the centroid position of the dot Dmn and the centroid position of the dot Dyn and the distance between the centroid position of the dot Dcn and the centroid position of the dot Dyn will always be substantially equal to each other, regardless of how much the dot Dyn is shifted in the sheet transfer direction. Thus, it is impossible to determine the shift amount Ybn.

For this reason, in the case where the centroid position of the dot Dmn and the centroid position of the dot Dcn are substantially the same in the sheet transfer direction, the controller 4 sets the shift amount Ybn to a value equal to $(\sqrt{3})/2$ of the distance Xbn between the centroid position of the dot Dmn and the centroid position of the dot Dcn in the print width direction.

Figure 8:
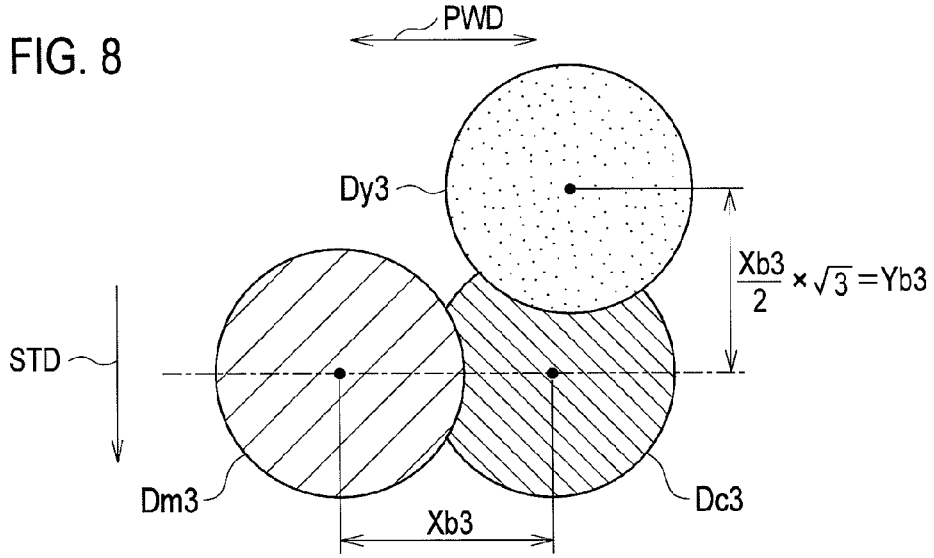
FIG. 8 is an explanatory diagram of the shift amount Ybn.

For example, in the example of FIG. 5(*f*), the centroid position of the dot Dm3 and the centroid position of the dot Dc3 in the head module line 51C are substantially the same in the sheet transfer direction. In this case, as shown in FIG. 8, the shift amount Yb3 is set to a value equal to $(\sqrt{3})/2$ of the distance Xb3 between the centroid position of the dot Dm3 and the centroid position of the dot Dc3.

Figure 9:
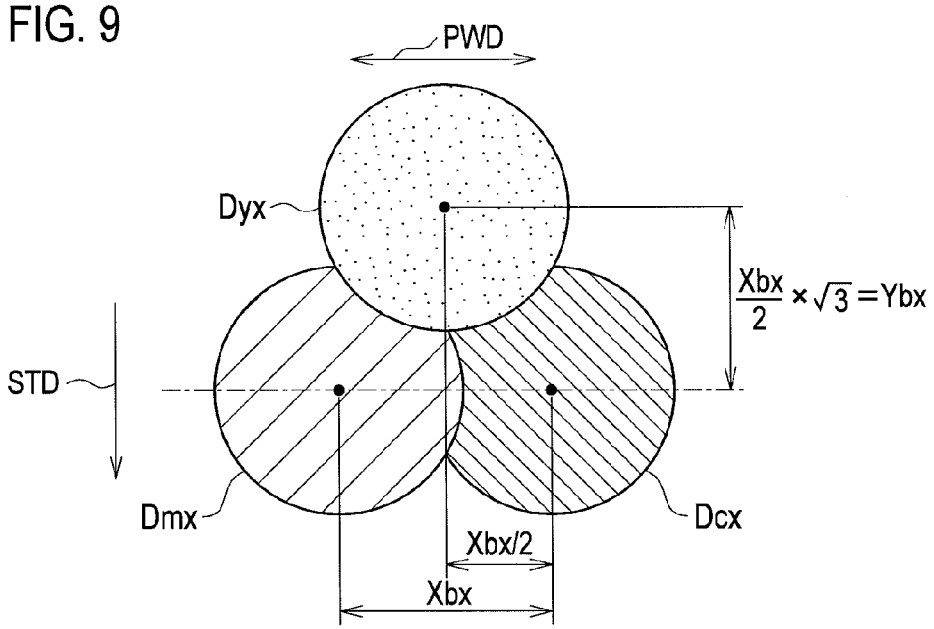
FIG. 9 is an explanatory diagram of the shift amount Ybn.

In the case where the centroid position of the dot Dyn is in between the centroid position of the dot Dmn and the centroid position of the dot Dcn in the print width direction, the shift amount is set as shown in FIG. 9. In the example of FIG. 9, a shift amount Ybx for a Y-ink dot Dyx is set to a value equal to $(\sqrt{3})/2$ of a distance Xbx between the centroid position of a dot Dmx of the head module 41M and the centroid position of a dot Dcx of the head module 41C. In this case, the dot Dmx, the dot Dcx, and the dot Dyx are arranged such that their centroid positions are the vertices of an equilateral triangle.

By setting the shift amount Ybn to a value equal to $(\sqrt{3})/2$ of Xbn as described above, the distances between the dots Dmn and Dcn and Dyn can be made equal to one another as shown in FIG. 9 in the case where the centroid position of the dot Dyn is in between the centroid position of the dot Dmn and the centroid position of the dot Dcn in the print width direction. The dots Dmn, Dcn, and Dyn can be located away from one another by a certain distance as shown in FIG. 8 in the case where the centroid position of the dot Dyn is not in between the centroid position of the dot Dmn and the centroid position of the dot Dcn in the print width direction.

Here, in a case where the shift amount Ybn is too large, that is, in a case where the second timing correction amount is too large, the dot of the head module 41Y gets too close to the adjacent line during printing and may possibly affect the print quality. Moreover, the dot of the head module 41Y gets too far away from the dots of the head modules 41M and 41C in the same line and may possibly make color shift noticeable. For this reason, the shift amount Ybn is limited to be not greater than a predetermined distance. Specifically, the controller 4 sets the shift amount Ybn to P/2 (Ybn=P/2) in the case where the shift amount Ybn found as described above is greater than P/2.

Referring back to FIG. 4, in step S10 after step S9, the controller 4 calculates, for each head module 41, an ejection timing correction amount $\Delta T$ which is the sum of the first timing correction amount and the second timing correction amount. Then, the controller 4 stores the ejection timing correction amount $\Delta T$ for the head module 41. Once the above steps done, the controller 4 ends the ejection timing correction amount determining process.

The ejection timing correction amount $\Delta T$ can be used continuously, unless replacement of the head module 41 or the like is performed. Thus, the above-described ejection timing correction amount determining process needs to be performed only once in the inkjet printing machine 1, unless replacement of the head module 41 or the like is performed.

Figure 10:
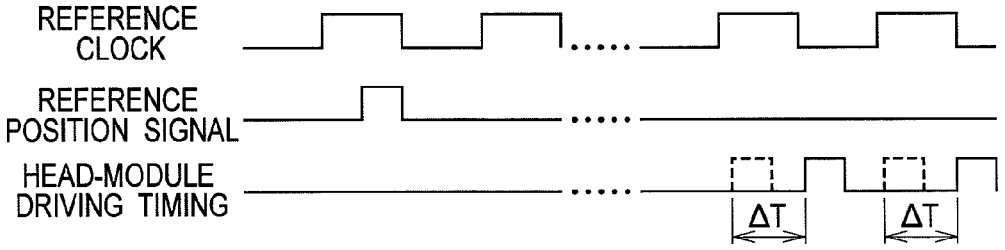
FIG. 10 is an explanatory diagram of control on the timings at which to drive head modules.

As shown in FIG. 10, in a printing operation, the controller 4 controls the timings at which the head driver 13 drives the head modules 41, based on a reference clock and a reference position signal. The reference clock is the output signal of the encoder 27 or a clock signal generated from the output signal of the encoder 27. The reference position signal is a signal generated at the timing at which the sheet sensor 28 detects the leading end of the sheet PA. As shown in FIG. 10, the controller 4 drives each head module 41 at a timing shifted from the original driving timing by the corresponding ejection timing correction amount ΔT.

As a result, the controller 4 controls the ink ejection timings of the head modules 41 such that dots of the four colors formed by the inks of the colors landing on the sheet PA have a positional relation similar to that among the dots Dkn, Dmn, Dcn, and Dyn shown in FIG. 5(*f*).

Specifically, the controller 4 controls the ink ejection timings of the head modules 41K, 41M, and 41C such that the distance between the landing position of the M ink and the landing position of the C ink covering the same pixel becomes substantially equal to the largest print-width-direction offset amount and the landing position of the K ink becomes substantially the same as the intermediate position between the landing position of the M ink and the landing position of the C ink in the sheet transfer direction.

Moreover, for each head module line 51 in which the landing position of the M ink and the landing position of the C ink covering the same pixel are substantially the same position in the sheet transfer direction, the controller 4 controls the ink ejection timing of the head module 41Y such that the distance between the landing position of the Y ink and the landing position of each of the M ink and the C ink in the sheet transfer direction becomes $(\sqrt{3})/2$ of the distance between the landing position of the M ink and the landing position of the C ink in the print width direction.

Moreover, for each head module line 51 in which the landing position of the M ink and the landing position of the C ink covering the same pixel are different positions in the sheet transfer direction, the controller 4 controls the ink ejection timing of the head module 41Y such that the distance between the landing position of the M ink and the landing position of the Y ink and the distance between the landing position of the C ink and the landing position of the Y ink become substantially equal.

As described above, in the inkjet printing machine 1, based on the positional relation in the print width direction among the nozzles, covering the same pixel, of the head modules 41 of the four colors in the head module lines 51A to 51F, the controller 4 controls the ink ejection timings of the head modules 41 in at least one of the head module lines 51 such that, among the landing positions of the inks of the four colors covering the same pixel, the landing position of the ink of one color is shifted in the sheet transfer direction from the landing positions of the inks of the other colors. In this way, it is possible to reduce the color difference in a printed image among the head module lines 51 resulting from the difference among the head module lines 51 in the offset of the positions of their head modules 41 in the print width direction, via adjustment of the landing positions of the inks of the four colors in the sheet transfer direction. Accordingly, the deterioration in print quality can be reduced.

Specifically, the controller 4 controls the ink ejection timings of the head modules 41 such that dots of the four colors formed by the inks of the colors landing on the sheet PA have a positional relation similar to that among the dots Dkn, Dmn, Dcn, and Dyn shown in FIG. 5(*f*).

As a result, the distance between the landing position of the M ink and the landing position of the C ink covering the same pixel becomes substantially equal among all the head module lines 51. Moreover, in each head module line 51, the K ink lands in between the M ink and the C ink in the sheet transfer direction. Further, in each head module line 51, the distance between the landing position of the M ink and the landing position of the Y ink and the distance between the landing position of the C ink and the landing position of the Y ink become substantially equal. Note that in each head module 51 in which the landing position of the M ink and the landing position of the C ink covering the same pixel are substantially the same position in the sheet transfer direction, and the landing position of the Y ink is not in between the landing position of the M ink and the landing position of the C ink in the print width direction, the distance between the landing position of the M ink and the landing position of the Y ink and the distance between the landing position of the C ink and the landing position of the Y ink do not become substantially equal. However, the M ink, the C ink, and the Y ink land at positions away from one another by a certain distance.

Figure 11A:
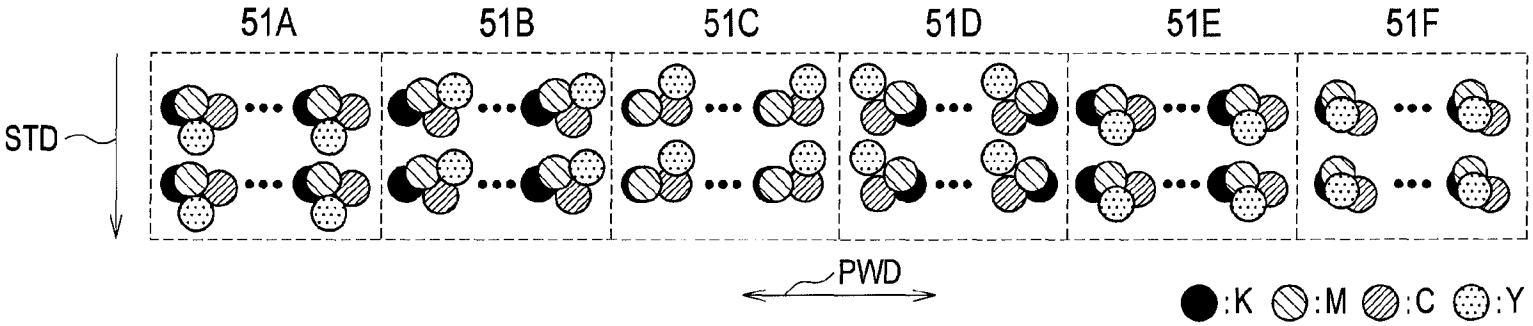
FIG. 11A is a diagram showing an example image of dots according to the embodiment.
Figure 11B:
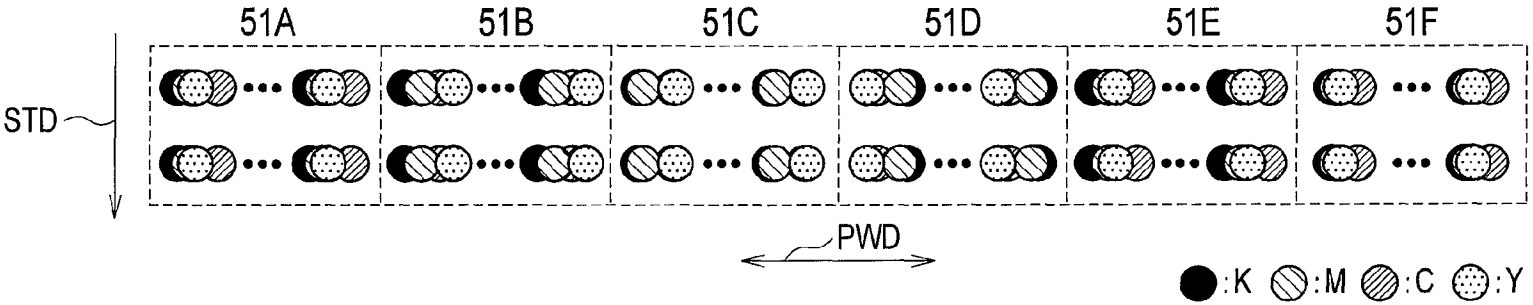
FIG. 11B RELATED ART
FIG. 11B is a diagram showing an image of dots according to a comparative example.

FIG. 11A shows an example image of dots having landing position arrangement as described above. As a comparative example, FIG. 11B shows an image of dots obtained by aligning the landing positions of the inks of the four colors in the sheet transfer direction as has been done in the conventional practice. By adjusting the landing positions of the inks of the four colors in the sheet transfer direction as shown in FIG. 11A, the color difference in a printed image among the head module lines can be reduced as compared to FIG. 11B. Accordingly, the deterioration in print quality can be reduced.

Moreover, the controller 4 limits the shift amount Ybn to P/2 or smaller. Specifically, the controller 4 limits the distance in the sheet transfer direction between the intermediate position between the landing position of the M ink and the landing position of the C ink covering the same pixel, and the landing position of the Y ink to P/2 or smaller. In this way, it is possible to prevent the dot of the head module 41Y from getting too close to its adjacent line and affecting the print quality. In addition, it is possible to prevent the dot of the head module 41Y from getting too far away from the dots of the head module 41M and the head module 41C in the same line and making color shift noticeable. Accordingly, the deterioration in print quality can be reduced.

Moreover, the controller 4 controls the landing positions of the K ink to be ejected from the head modules 41K of the ink head 32K such that the positions will be substantially the same in the sheet transfer direction. Accordingly, it is possible to reduce the deterioration of printed images such as black letters and characters and black ruled lines whose misalignment is easily noticeable. In addition, it is possible to reduce the deterioration of printed images printed with only the K ink. Here, black (K) corresponds to a first color.

Moreover, in the ejection timing correction amount determining process, the inkjet printing machine 1 uses black (K), or the first color, as a reference, and uses magenta (M), cyan (C), and yellow (Y) as second, third, and fourth colors, respectively. Further, the distance between the landing position of the M ink, which is a reddish color whose color shift is easily noticeable, and the landing position of the C ink is controlled to be substantially equal among all the head module lines 51. Accordingly, it is possible to reduce the color shift of magenta (M) and thus to reduce the color difference in a printed image among the head module lines.

Note that an ink of a color other than magenta (M) such as red is sometimes used as an ink of a reddish color. In this case, that reddish color should be used as the second color.

In the above embodiment, the inkjet printing machine 1 including the four ink heads 32K, 32C, 32M, and 32Y has been described. Now, a configuration will be described in which an ink head 32 configured to eject an ink of a fifth color other than K, C, M, and Y is added.

In this case, the controller 4 determines the mapping between each nozzle of the ink head 32 of one of the colors K, M, C, and Y with the closest hue to the fifth color, and the corresponding nozzle of the ink head 32 of the fifth color such that the distance between the center positions of these nozzles become equal to or smaller than P/2, the nozzles covering the same pixel.

Here, when the fifth color is, for example, gray, light gray, or the like, the color with the closest hue to the fifth color among K, M, C, and Y is K (black). Moreover, when the fifth color is, for example, light magenta, red, or the like, the color with the closest hue to the fifth color among K, M, C, and Y is M (magenta). Further, when the fifth color is, for example, light cyan, blue, violet, or the like, the color with the closest hue to the fifth color among K, M, C, and Y is C (cyan). Furthermore, when the fifth color is, for example, orange or the like, the color with the closest hue to the fifth color among K, M, C, and Y is Y (yellow).

During printing, the controller 4 controls the ejection timing of the ink of the fifth color such that the landing position of the ink of the color with the closest hue to the fifth color and the landing position of the ink of the fifth color covering the same pixel become substantially the same position in the sheet transfer direction.

In this way, it is possible to reduce the color difference in a printed image among the head module lines in the line-type inkjet printing machine capable of five-color printing. Accordingly, the deterioration in print quality can be reduced.

Moreover, in a case of a configuration with three ink heads 32, a process omitting the operations for yellow (Y), or the fourth color, in the above embodiment should be performed.

Specifically, in the ejection timing correction amount determining process, steps S8 and S9 should be omitted. Then, during printing, the controller 4 should control the ejection timing of each head module 41 of each of the three ink heads 32 by using the ejection timing correction amount ΔT for the head module 41 found in this ejection timing correction amount determining process.

In this way, it is possible to reduce the color difference in a printed image among the head module lines in the inkjet printing machine with the three ink heads 32. Accordingly, the deterioration in print quality can be reduced.

Here, when black (K) is included in the three colors for the three ink heads 32, black (K) is set as a first color as in the above embodiment. Moreover, when black (K) and a reddish color such as magenta (M) are included in the three colors, black (K) and the reddish color such as magenta (M) are set as first and second colors, respectively, as in the above embodiment.

Moreover, in a case of a configuration with two ink heads 32, a process should be performed such that the two colors therefor will have a relation similar to that between magenta (M) and cyan (C) in the above embodiment.

Specifically, the controller 4 determines the mapping between each nozzle of one ink head 32 and the corresponding nozzle of the other ink head 32 covering the same pixel such that the distance between the center positions of these nozzles in the print width direction becomes equal to or smaller than P/2. Then, during printing, the controller 4 controls the ejection timing of each head module 41 such that the distance between the landing position of the ink of one color and the landing position of the ink of the other color covering the same pixel become substantially equal to the largest print-width-direction offset amount.

In this way, it is possible to reduce the color difference in a printed image among the head module lines in the inkjet printing machine with the two ink heads 32. Accordingly, the deterioration in print quality can be reduced.

Here, when black (K) is included in the two colors for the two ink heads 32, the controller 4 controls the landing positions of the K ink to be ejected from the head modules 41K of the K ink head 32K such that the positions become substantially the same in the sheet transfer direction. Accordingly, it is possible to reduce the deterioration of printed images such as black letters and characters and black ruled lines whose misalignment is easily noticeable. In addition, it is possible to reduce the deterioration of printed images printed with only the K ink.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printing machine, comprising:

a printing unit configured to perform printing on a sheet while transferring the sheet in a transfer direction; and a controller configured to control the printing unit, wherein the printing unit includes a plurality of head module groups arranged side by side in the transfer direction and configured to eject inks of different colors, each of the plurality of head module groups includes a plurality of head modules aligned along a print width direction perpendicular to the transfer direction and each head module configured to eject an ink of a same color, each of the plurality of head modules includes a plurality of nozzles arranged along the print width direction at a nozzle pitch and configured to eject the ink, the plurality of head modules forms a plurality of head module lines arranged side by side in the print width direction, each of the head module lines including head modules of the different colors of the head modules arranged in a line along the transfer direction and configured to eject the inks of the different colors, and the controller is configured to control ink ejection timings of the plurality of head modules on a basis of a positional relation in the print width direction between the nozzles, covering a same pixel, of the plurality of head modules of the different colors in each of the plurality of head module lines such that, of landing positions of the inks ejected from the nozzles of the different colors covering the same pixel, the landing position of the ink from the nozzle of at least one of the different colors is shifted in the transfer direction from with respect to the landing positions of the inks ejected from the nozzles of the other colors in at least one of the plurality of head module lines.

2. The inkjet printing machine according to claim 1, wherein the plurality of head module groups includes a first head module group configured to eject an ink of a first color and a second head module group configured to eject an ink of a second color, the controller is configured to determine a mapping between the nozzles of the first and second head module groups such that a distance in the print width direction between center positions of the nozzles of the first head module group and the second head module group covering the same pixel becomes equal to or smaller than ½ of the nozzle pitch, and control the ink ejection timings of the plurality of head modules such that a distance between the landing positions of the ink of the first color and the ink of the second color covering the same pixel becomes equal to a largest print-width-direction offset amount, and the largest print-width-direction offset amount is a largest amount of offset in the print width direction between the inks from the nozzles of the head modules of the first head module group and the second head module group covering the same pixel among the plurality of head module lines.

3. The inkjet printing machine according to claim 2, wherein the first color is black, and the controller is configured to control the ink ejection timings of the plurality of head modules of the plurality of head module groups such that the landing positions of the ink of the first color ejected from the nozzles of the plurality of head modules of the first head module group become the same position in the transfer direction.

4. The inkjet printing machine according to claim 3, wherein the second color is a reddish color.

5. The inkjet printing machine according to claim 1, wherein the plurality of head module groups includes a first head module group configured to eject an ink of a first color, a second head module group configured to eject an ink of a second color, and a third head module group configured to eject an ink of a third color the controller is configured to determine a mapping among the nozzles of the first to third head module groups such that a distance in the print width direction between center positions of the nozzles of the first head module group and the second head module group covering the same pixel becomes equal to or smaller than ½ of the nozzle pitch and such that a distance in the print width direction between the center position of the nozzles of the second head module group and a center position of the nozzles of the third head module group covering the same pixel becomes equal to or smaller than ½ of the nozzle pitch, and control the ink ejection timings of the plurality of head modules such that a distance between the landing positions of the ink of the second color and the ink of the third color covering the same pixel becomes equal to a largest print-width-direction offset amount and such that the landing position of the ink of the first color becomes the same as an intermediate position in the transfer direction between the landing positions of the ink of the second color and the ink of the third color, and the largest print-width-direction offset amount is a largest amount of offset in the print width direction between the inks from the nozzles of the head modules of the second head module group and the third head module group covering the same pixel among the plurality of head module lines.

6. The inkjet printing machine according to claim 5, wherein the plurality of head module groups further includes a fourth head module group configured to eject an ink of a fourth color, the controller is configured to determine a mapping among the nozzles of the first to fourth head module groups such that a distance in the print width direction between an intermediate position in the print width direction between the center positions of the nozzles of the second head module group and the third head module group covering the same pixel, and a center position of the corresponding nozzle of the fourth head module group becomes equal to or smaller than ½ of the nozzle pitch, for the head module line in which the landing positions of the ink of the second color and the ink of the third color covering the same pixel are the same position in the transfer direction, control an ejection timing of the ink of the fourth color such that a distance in the transfer direction between the landing position of the ink of the fourth color and the landing position of the ink of the second color and the ink of the third color becomes equal to (3)/2 of a distance in the print width direction between the landing position of the ink of the second color and the landing position of the ink of the third color, and for the head module line in which the landing positions of the ink of the second color and the ink of the third color covering the same pixel are different positions in the transfer direction, control the ejection timing of the ink of the fourth color such that a distance between the landing position of the ink of the second color and the landing position of the ink of the fourth color, and a distance between the landing position of the ink of the third color and the landing position of the ink of the fourth color become equal.

7. The inkjet printing machine according to claim 6, wherein the controller is configured to limit a distance in the transfer direction between the intermediate position between the landing positions of the ink of the second color and the ink of the third color covering the same pixel, and the landing position of the ink of the fourth color, to a predetermined distance or smaller.

8. The inkjet printing machine according to claim 6, wherein the plurality of head module groups further includes a fifth head module group configured to eject an ink of a fifth color, the controller is configured to determine a mapping among the nozzles of the first to fifth head module groups such that a distance between the center positions of the nozzles, covering the same pixel, of the fifth head module group and the head module group of one of the first to fourth colors with a closest hue to the fifth color becomes equal to or smaller than ½ of the nozzle pitch, and control an ejection timing of the ink of the fifth color such that the landing positions, covering the same pixel, of the ink of the fifth color and the ink of the color with the closest hue to the fifth color become the same position in the transfer direction.

9. The inkjet printing machine according to claim 1, wherein the controller is configured to determine a mapping between the nozzles of first and second head module groups, which eject inks of different colors, such that a distance, in the print width direction, between center positions of the nozzles of the first head module group and the second head module group covering the same pixel becomes equal to or smaller than ½ of the nozzle pitch.

10. The inkjet printing machine according to claim 1, wherein the controller is configured to control the ink ejection timing of the plurality of head modules such that a distance between the landing positions of the ink of a first color and the ink of a second color, covering the same pixel, becomes equal to a largest print-width-direction offset amount, and the largest print-width-direction offset amount is a largest amount of offset, in the print width direction, between the inks from the nozzles of the head modules of a first head module group and a second head module group covering the same pixel.

* * * * *

UNITED STATES PATENT AND TRADEMARK OFFICE

CERTIFICATE OF CORRECTION

PATENT NO. : 9,090,087 B2
APPLICATION NO. : 14/291809
DATED : July 28, 2015
INVENTOR(S) : Bansyo It is certified that error appears in the above-identified patent and that said Letters Patent is hereby corrected as shown below:

In the Claims,

Claim 1, column 18, line 56, change "from with respect" to --with respect--.

Signed and Sealed this
Twenty-second Day of March, 2016

Michelle K. Lee

Michelle K. Lee
*Director of the United States Patent and Trademark Office*